US010410592B2

(12) United States Patent
Yi et al.

(10) Patent No.: US 10,410,592 B2
(45) Date of Patent: Sep. 10, 2019

(54) DRIVING METHOD FOR REDUCING GHOSTING OF ELECTROPHORETIC DISPLAY

(71) Applicants: Shenzhen Guohua Optoelectronics Co. Ltd, Guangdong (CN); South China Normal University, Guangdong (CN); Academy of Shenzhen Guohua Optoelectronics, Guangdong (CN)

(72) Inventors: Zichuan Yi, Guangzhou (CN); Li Wang, Guangzhou (CN); Guofu Zhou, Guangzhou (CN)

(73) Assignees: Shenzhen Guohua Optoelectronics Co., Guandong (CN); South China Normal University, Guangdong (CN); Academy of Shenzhen Guohua, Guandong (CN)

( * ) Notice: Subject to any disclaimer, the term of this patent is extended or adjusted under 35 U.S.C. 154(b) by 0 days.

(21) Appl. No.: 15/764,228

(22) PCT Filed: Apr. 13, 2016

(86) PCT No.: PCT/CN2016/079143
§ 371 (c)(1),
(2) Date: Mar. 28, 2018

(87) PCT Pub. No.: WO2017/054435
PCT Pub. Date: Apr. 6, 2017

(65) Prior Publication Data

US 2018/0286318 A1 Oct. 4, 2018

(30) Foreign Application Priority Data

Sep. 30, 2015 (CN) ..... 2015 1 0644105

(51) Int. Cl.
*G09G 3/34* (2006.01)

(52) U.S. Cl.
CPC ..... *G09G 3/344* (2013.01); *G09G 3/34* (2013.01); *G09G 2310/06* (2013.01); *G09G 2320/0204* (2013.01); *G09G 2320/0257* (2013.01)

(58) Field of Classification Search
CPC .. G09G 3/344; G09G 3/34; G09G 2320/0257; G09G 2320/0204; G09G 2310/06
See application file for complete search history.

(56) References Cited

U.S. PATENT DOCUMENTS 8,456,414 B2 * 6/2013 Lin ..... G09G 3/344 345/107
2003/0151580 A1 * 8/2003 Ma ..... G09G 3/3622 345/96

(Continued)

FOREIGN PATENT DOCUMENTS

CN 1809861 A 7/2006
CN 1849643 A 10/2006

(Continued)

OTHER PUBLICATIONS

Proquest Dialog Search Strategy and Search Result Summary, downloaded Apr. 4, 2019, citing JP 4690079 B2 published Jun. 1, 2011 and CN 100476560 C published Apr. 8, 2009. (Year: 2011).*

(Continued)

*Primary Examiner* — Darlene M Ritchie
(74) *Attorney, Agent, or Firm* — Thorpe North and Western

(57) ABSTRACT

A driving method for reducing ghosting in an electrophoretic display is provided without prolonging driving waveform time and scintillation by improving a driving waveform design. The method comprises four steps: erasing an original image (S1); activating activity of electrophoretic particle (S2); activating electrophoretic particle (S3); and writing a new image (S4). At the electrophoretic particle activating (Continued)

(S3) stage, the electrophoretic particle activating is carried out for a preset duration time ($t_x$), wherein the voltage of the driving waveform is 0V within the preset duration time ($t_x$).

6 Claims, 8 Drawing Sheets

(56) References Cited

U.S. PATENT DOCUMENTS

| | | | | |
|---|---|---|---|---|
| 2006/0197738 | A1* | 9/2006 | Kawai | G09G 3/344 345/107 |
| 2007/0200874 | A1* | 8/2007 | Amundson | G09G 3/344 345/690 |
| 2009/0179923 | A1* | 7/2009 | Amundson | G09G 3/344 345/690 |
| 2010/0134538 | A1 | 6/2010 | Sprague et al. | |
| 2011/0074756 | A1* | 3/2011 | Markvoort | G09G 3/344 345/211 |
| 2011/0261035 | A1* | 10/2011 | Miyazaki | G09G 3/207 345/205 |
| 2012/0087389 | A1* | 4/2012 | Howe | G01K 7/00 374/142 |
| 2012/0182282 | A1* | 7/2012 | van Veenendaal | G09G 3/344 345/212 |
| 2012/0212470 | A1* | 8/2012 | van Veenendaal | G09G 3/2018 345/211 |
| 2016/0171935 | A1* | 6/2016 | Ben-Dov | G09G 3/344 345/691 |
| 2017/0337880 | A1* | 11/2017 | Nishiike | G09G 3/344 |

FOREIGN PATENT DOCUMENTS

| | | | |
|---|---|---|---|
| CN | 103680426 | A | 3/2014 |
| CN | 105070254 | A | 11/2015 |
| CN | 105139811 | A | 12/2015 |
| WO | WO 2005/071650 | A1 | 8/2005 |

OTHER PUBLICATIONS

PCT Application No. PCT/CN2016/079143 Zichuan Yi, International Search Report, dated Jul. 7, 2016, 6 Pages.

* cited by examiner

DRIVING METHOD FOR REDUCING GHOSTING OF ELECTROPHORETIC DISPLAY

FIELD OF THE INVENTION

The present invention relates to a driving method for reducing ghosting in an electrophoretic display (EPD), which belongs to the field of electrophoretic displays.

BACKGROUND OF THE INVENTION

Recently, EPDs have aroused extensive attention and are widely applied in E-book readers and other fields due to their low power consumption, no-backlight and the paper-like display. The EPDs are manufactured by means of charged electrophoretic particles directionally, which move in a direction opposite to their charge under the action of an electric field. In addition, they have good bistable characteristics. Therefore, the EPDs consume little power during static display and have a lower radiation than conventional liquid crystal displays, and thus are one of energy-saving and environmentally-friendly display technologies. However, EPDs still have a series of disadvantages, for example, slow response speed, ghosting easily occurring when an image is refreshed, blinking during image switching and the like. Due to these disadvantages, the display effect of EPDs is seriously affected, and the application range of EPDs is restricted in the market.

The gray level displaying in an EPD is mainly formed by applying a voltage sequence to a pixel electrode. The voltage sequence is called the driving waveform. A major disadvantage shown by an EPD is caused by the poor design of the driving waveform. The existing methods for eliminating ghosting in an EPD are mainly causing multiple times of refreshing between the black state and white state. These methods cause serious blinking in the display screen, thus affecting the comfort for reading. Meanwhile, since the duration for driving the display screen to display between white state and black state is long, the response speed of EPDs is also affected.

SUMMARY OF THE INVENTION

To overcome the limitations of the known technology, an object of the present invention is to provide a driving method for reducing ghosting in EPDs, which solves the technical problem of ghosting residues in an EPD, by improving the driving waveform without greatly increasing the blinking of a display screen and the time of driving waveform.

The object is achieved by means of the following technical solutions.

A driving method for reducing ghosting in an EPD is provided, where a driving voltage is applied to a driving pixel electrode to realize display driving in an EPD. The method includes the following steps: S1: erasing an original image; S2: activating electrophoretic particles: S3: standing the electrophoretic particles and, S4: writing a new image.

Further, in the step S3, the electrophoretic particles are stood for a preset duration, and a driving voltage of 0 V is applied within the preset duration.

Further, the value calculation of the preset duration includes the following steps:

S01: at the end of the step S2, measuring the change in reflectivity of an EPD, and taking a limited number of EPD reflectivity values and coordinate points of the elapsed time;

S02: establishing a mathematical model equation $$y = \frac{P1}{x} + P0,$$

where y is the reflectivity of the EPD, x is the elapsed time at the end of the step S2, and P1 and P0 are hyperbolic function coefficients;

S03: substituting the coordinate points in the equation $$y = \frac{P1}{x} + P0$$

to calculate values of the hyperbolic function coefficients P1 and P0, and substituting the values of P1 and P0 in the equation $$y = \frac{P1}{x} + P0$$

to embody the equation; and

S04: specifying a value range of at least one of y and x according to the requirements for the reflectivity and the duration of driving waveform, and calculating the value of the desired preset duration for satisfying the requirements.

Further, in the steps from S1 to S4, the driving waveform within one period complies with a DC balance rule.

Further, the duration of a non-zero driving voltage in the step S1 is equal to the duration of a non-zero driving voltage in the step S4.

Further, in the steps from S1 to S4, the waveform of the driving voltage is square.

Further, the reference gray level is the white gray level.

The present invention has the following beneficial effects. A stage of standing the EPD is additionally provided between the stage of activating particles and the stage of writing a new image, so that a new image is written after the activating state and becomes stable. And then, the ghosting reduction effect is achieved. At the same time, the duration of the waiting stage in the stage of writing a new image can be subtracted from the duration of the corresponding stage, so that the effect of adding no additional time is realized. Since the driving waveform complies with the DC balance, DC residues can be prevented from damaging the EPD. In addition, in the technical solutions of the present invention, a method for designing the duration of standing the electrophoretic particles is further disclosed, so that a reference can be provided for the automatic design for the driving waveform.

BRIEF DESCRIPTION OF THE DRAWINGS

The disclosure of the invention will be further described below by embodiments with reference drawings, in which.

DETAILED DESCRIPTION OF THE EMBODIMENTS

Figure 1:
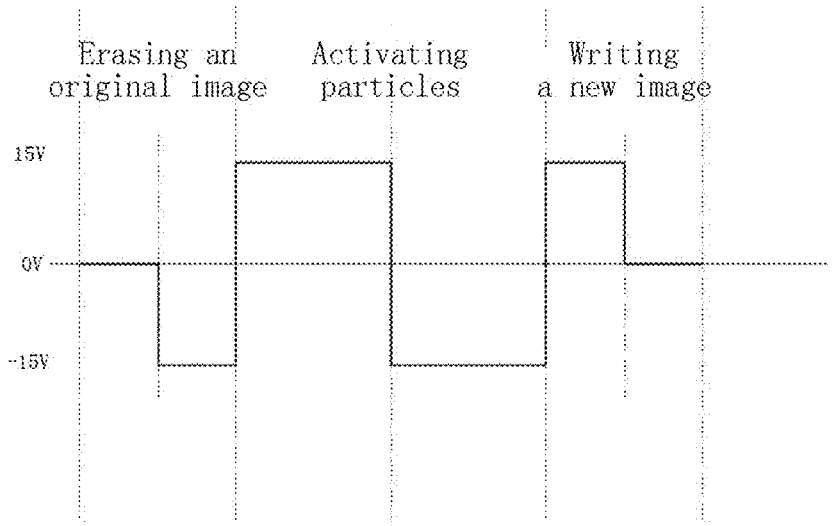
Fig. 1 (Prior Art)
FIG. 1 is a schematic diagram of a conventional driving waveform.
Figure 2:
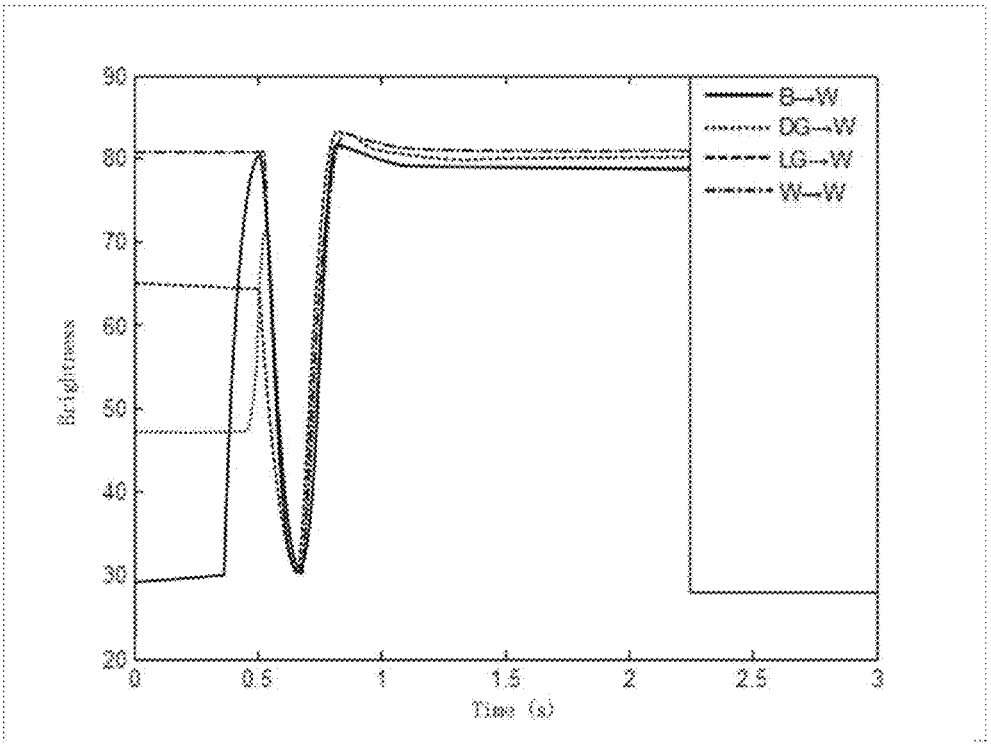
Fig. 2 (Prior Art)
FIG. 2 is a driving effect diagram A of the conventional driving waveform.
Figure 3:
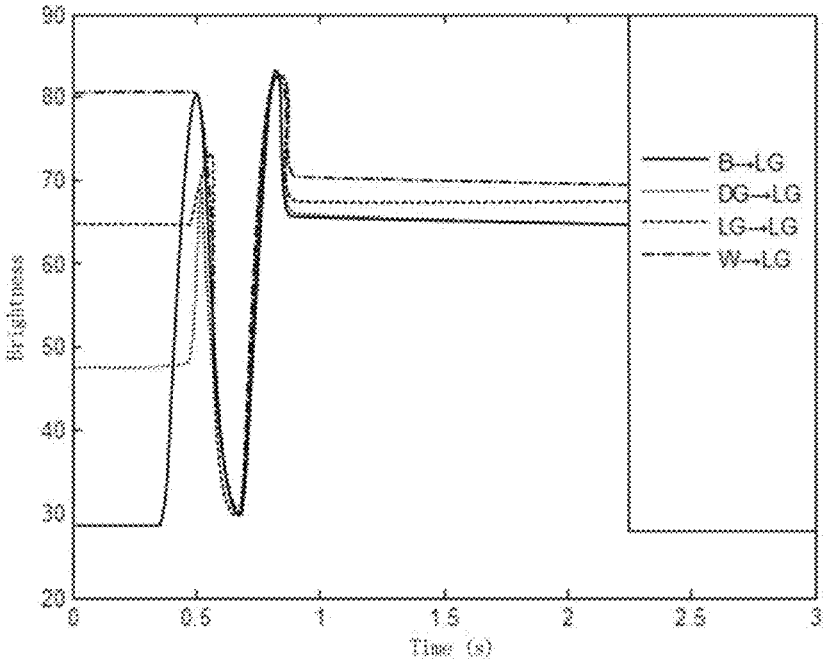
Fig. 3 (Prior Art)
FIG. 3 is a driving effect diagram B of the conventional driving waveform.
Figure 4:
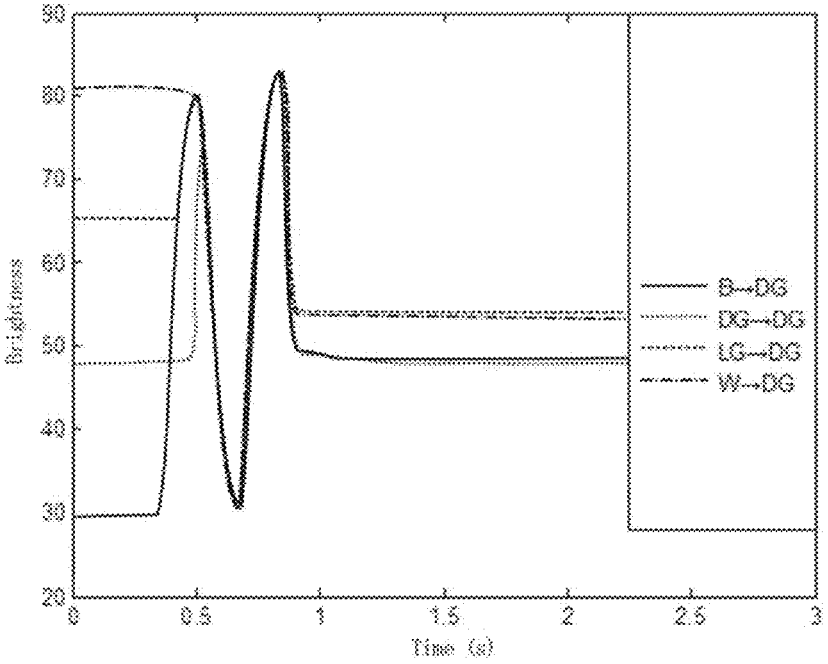
Fig. 4 (Prior Art)
FIG. 4 is a driving effect diagram C of the conventional driving waveform.
Figure 5:
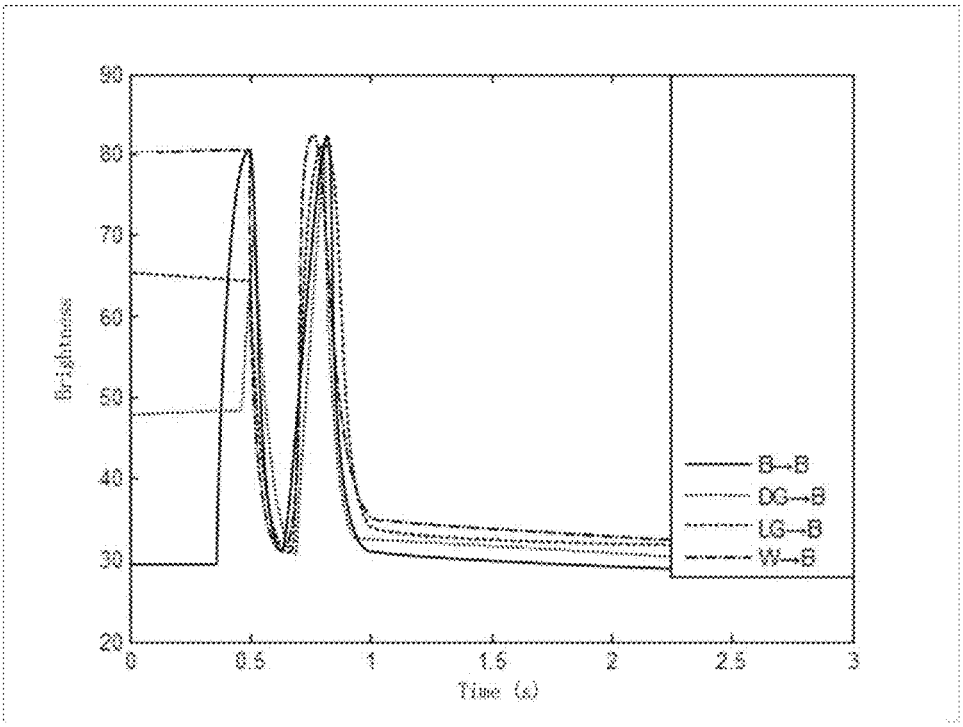
Fig. 5 (Prior Art)
FIG. 5 is a driving effect diagram D of the conventional driving waveform.

Referring to FIG. 1, the conventional driving waveform includes three steps: erasing an original image, activating electrophoretic particles, and writing a new image. Due to the influences from different factors such as unstable voltage, different driving performances of particles resulting from different standing times, different activities of particles resulting from different driving waveforms and the like, the final reflectivity (i.e., ghosting residues) is different when writing a same target gray level. The driving effect of the conventional driving waveform is tested by a commercial E-ink EPD, where pixels in four different original gray levels, i.e., white, light gray, dark gray and black, are written to a same target gray level under the effect of the conventional driving waveform. Since the relationship between the brightness and the reflectivity is known and expressed by $L^*=116(R/R_0)^{1/3}-16$ (where R is the reflectivity of a sample, $R_0$ is the reference standard of the reflectivity of 100% and L* is a basic unit of the brightness) and the brightness L* is positively correlated with the reflectivity R, the influence of the conventional driving waveform on the reflectivity of pixels can be known by observing the change in brightness of the measured pixels. FIGS. 2-5 show the change of the brightness of the measured pixels during applying the conventional driving waveform. W, LG, BG and B denote the brightness of pixels in four original gray levels, i.e., white, light gray, dark gray and black, respectively. FIG. 2 shows a curve of the brightness after the pixels in the four original gray levels W, LG, BG and B are refreshed to the target gray level white by using the conventional driving waveform: FIG. 3 shows a curve of the brightness after the pixels in the four original gray levels W, LG, BG and B are refreshed to the target gray level light gray by using the conventional driving waveform: FIG. 4 shows a curve of the brightness after the pixels in the four original gray levels W, LG, BG and B are refreshed to the target gray level dark gray by using the conventional driving waveform, and, FIG. 5 shows a curve of the brightness after the pixels in the four original gray levels W, LG, BG and B are refreshed to the target gray level black by using the conventional driving waveform. It can be known from the curve in FIG. 2 that the four brightness curves refreshed to the target gray level white are discrete and do not reach the brightness in the same target gray level. The results shown in FIGS. 3-5 are the same as that in FIG. 2, and thus are omitted here. Therefore, it can be known that the same target gray level cannot be really achieved after the pixels in different original gray levels are refreshed to the same target gray level by using the conventional driving waveform.

Figure 6:
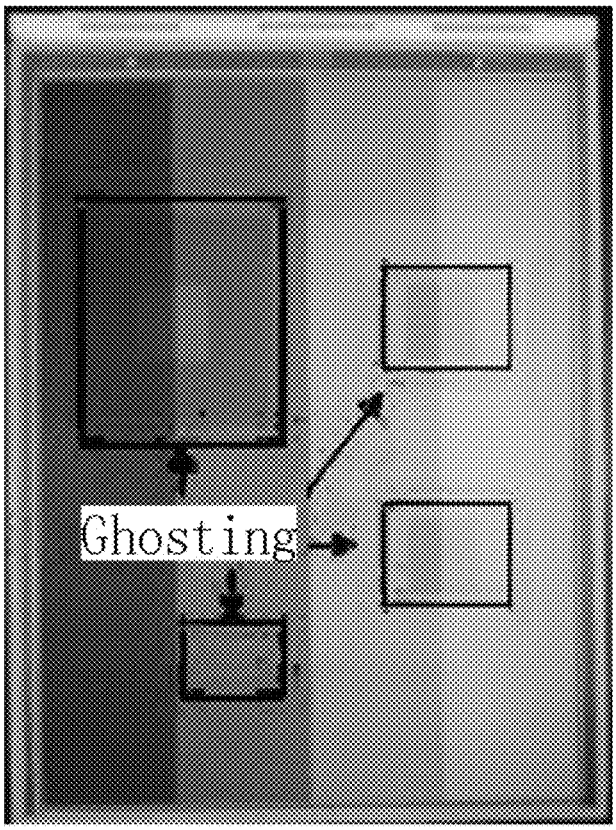
Fig. 6 (Prior Art)
FIG. 6 is a schematic diagram of a ghosting image after applying the conventional driving waveform in FIG. 1.

Referring to FIG. 6, at the end of the conventional driving waveform, there are ghosting residue image in the EPD.

Figure 7:
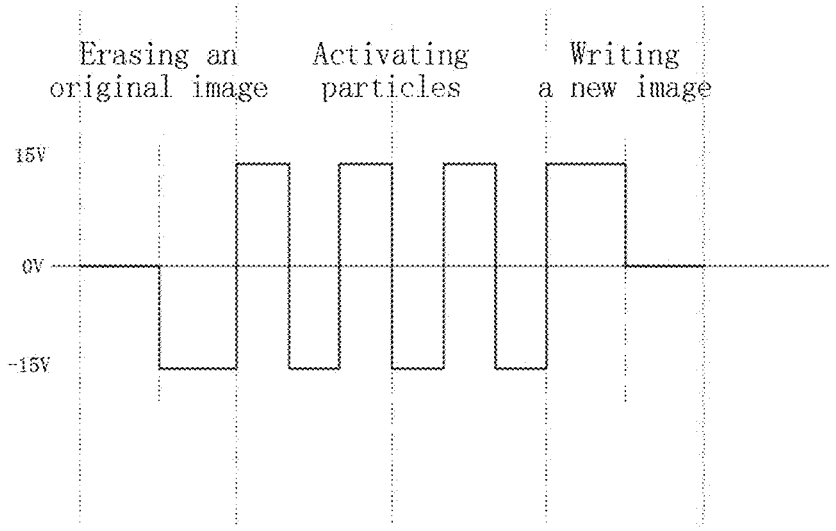
FIG. 7 is a schematic diagram of an improved driving waveform added with multiple times of refreshing between black and white.

Referring to FIG. 7, in order to overcome the disadvantages of ghosting residues in the conventional driving waveform, in an improved driving waveform, on the basis of the conventional driving waveform, the stage of activating electrophoretic particles is improved. The activity of particles is further activated by additionally refreshing the pulse waveform between the black and white gray levels for many times, so that the generation of ghosting is inhibited. However, the improved driving waveform will result in new deficiencies, such as blinking and increased power consumption.

Figure 8:
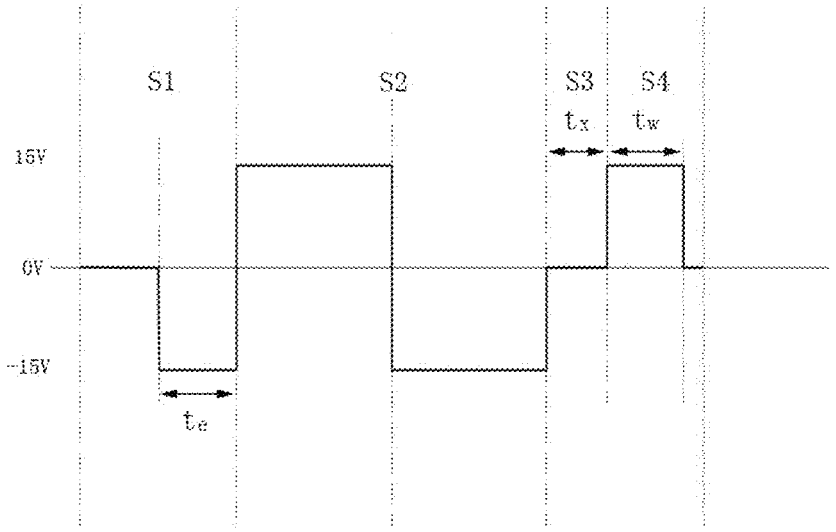
FIG. 8 is a schematic diagram of a driving waveform in a first driving method embodiment for reducing ghosting of an EPD according to the disclosure.

FIG. 8 shows a driving waveform in a first embodiment of a driving method for reducing ghosting of an EPD according to the disclosure.

The specific implementation of the first embodiment for reducing ghosting in an EPD according to the disclosure will be described below.

A commercial E-ink EPD is used as a display device, and the reference gray level is set as white. In the first embodiment of the disclosure, a driving method for reducing ghosting of an EPD is provided, where a driving voltage is applied to a driving pixel electrode of the EPD to realize display driver, and the method includes the following steps: S1: erasing an original image; S2: activating electrophoretic particles; S3: standing the electrophoretic particles; and, S4: writing a new image. The step S1 includes: a stage of applying a driving voltage of 0 V, a waiting stage for completing gray level conversion, and an erasing stage used for erasing the original image. The duration of the erasing stage (i.e., the duration of applying a non-zero driving voltage in the step S1) is $t_e$, and the waveform is a square wave whose value is 15V, so that the pixels with the original image are erased to the reference gray level.

In the step S2, for the purpose of activating the activity in EPDs, a forward voltage of 15V is applied to the driving electrode, where the waveform is a square wave and the duration is half of the total duration in the step S2; and then, a backward voltage of 15V is applied to the driving electrode, where the waveform is a square wave and the duration is half of the total duration in the step S2.

Further, in the step S3, the electrophoretic particles are stood for a preset duration $t_x$, and a driving voltage of 0 V is applied within the preset duration $t_x$. The calculation of the value of the preset duration $t_x$ specifically includes the following steps.

S01: At the end of the step S2, a rectangular plane coordinate system is established, the time is used as the x-axis and the reflectivity of the EPD as the y-axis, the change in reflectivity of the EPD is measured, and a limited number of EPD reflectivity values and coordinate points of the elapsed time are sampled. 40 coordinate points are exemplarily sampled, and a fitted curve is drawn according to the distribution of the coordinate points.

S02: A mathematical model equation $$y = \frac{P1}{x} + P0$$

is established, where y is the reflectivity of the EPD, x is the elapsed time at the end of the step S2, and P1 and P0 are hyperbolic function coefficients.

S03: The coordinate points are substituted in the equation $$y = \frac{P1}{x} + P0$$

to calculate values of the hyperbolic function coefficients P1 and P0, and the values of P1 and P0 are substituted into the equation $$y = \frac{P1}{x} + P0$$

to obtain equation.

S04: The value range of y or x is specified according to the requirements from the reflectivity and the duration of driving waveform, for example, according to the requirements from the reflectivity in the gray level of the original image, the target gray level of the next image, and the duration of driving waveform. And the value of the desired preset duration $t_x$ satisfying the requirements is calculated. Thus, it is advantageous to satisfy the requirements of the automatic design for driving waveform.

The step S4 includes a write-in stage of writing a new image, a stage of applying a voltage waveform of 0 V and a waiting stage to complete gray level conversion, where the duration of the write-in stage (i.e., the duration of applying a non-zero voltage waveform in the step S4) is $t_w$, and the driving voltage waveform is a square wave whose value is 15 V, so that the pixels are written into the target gray level. The duration $t_w$ of the write-in stage is equal to the duration t of the erasing stage.

Further, to prevent DC residues from damaging the EPD, in the steps from S1 to S4, the driving waveform with one period should comply with DC balance. In the steps from S1 to S4, the voltage for the driving waveform is a square wave, and the value of the forward voltage is equal to the backward voltage. The duration $t_4$ of applying a non-zero driving voltage in the step S1 is equal to the duration $t_w$ of applying a non-zero voltage in the step S4, and the voltage within the duration $t_e$ is a forward voltage, and the voltage within the duration $t_w$ is a backward voltage. In the step S2, the duration of applying a forward voltage is equal to the duration of applying a backward voltage. In the step S3, the voltage is 0 V. Therefore, within the whole period from the steps from S1 to S4, the driving waveform complies with the DC balance.

Figure 9:
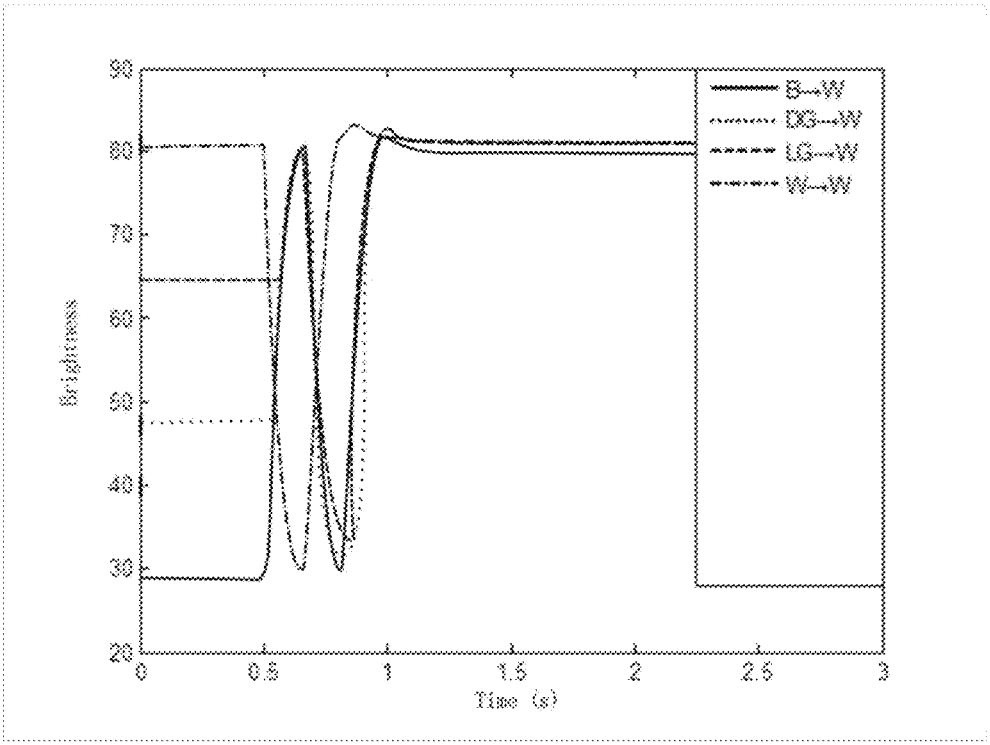
FIG. 9 is a driving effect diagram A' when applying the driving waveform in the first embodiment for reducing ghosting of an EPD according to the disclosure.
Figure 10:
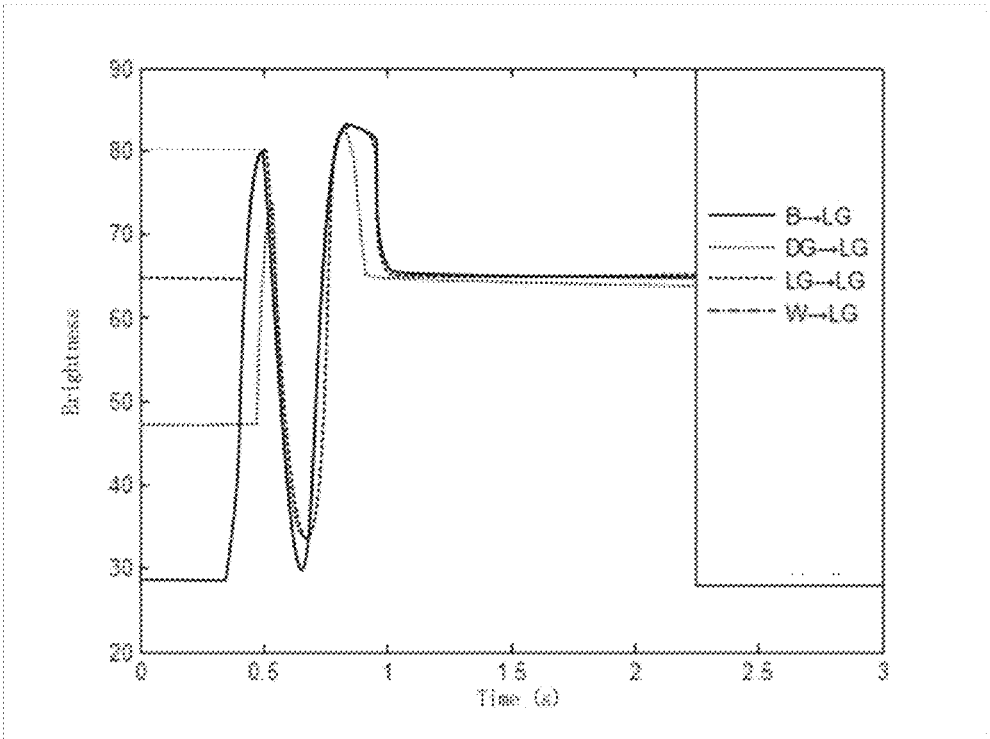
FIG. 10 is a driving effect diagram B' when applying the driving waveform in the first embodiment for reducing ghosting of an EPD according to the disclosure.
Figure 11:
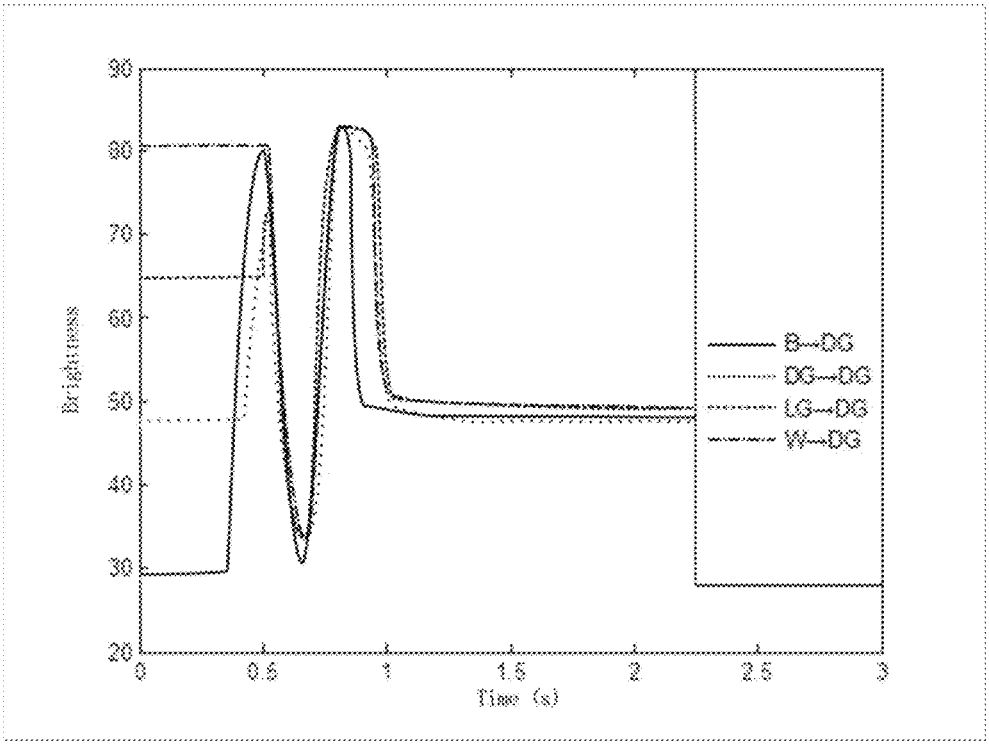
FIG. 11 is a driving effect diagram C' when applying the driving waveform in the first embodiment of the driving method for reducing ghosting of an EPD according to the disclosure.
Figure 12:
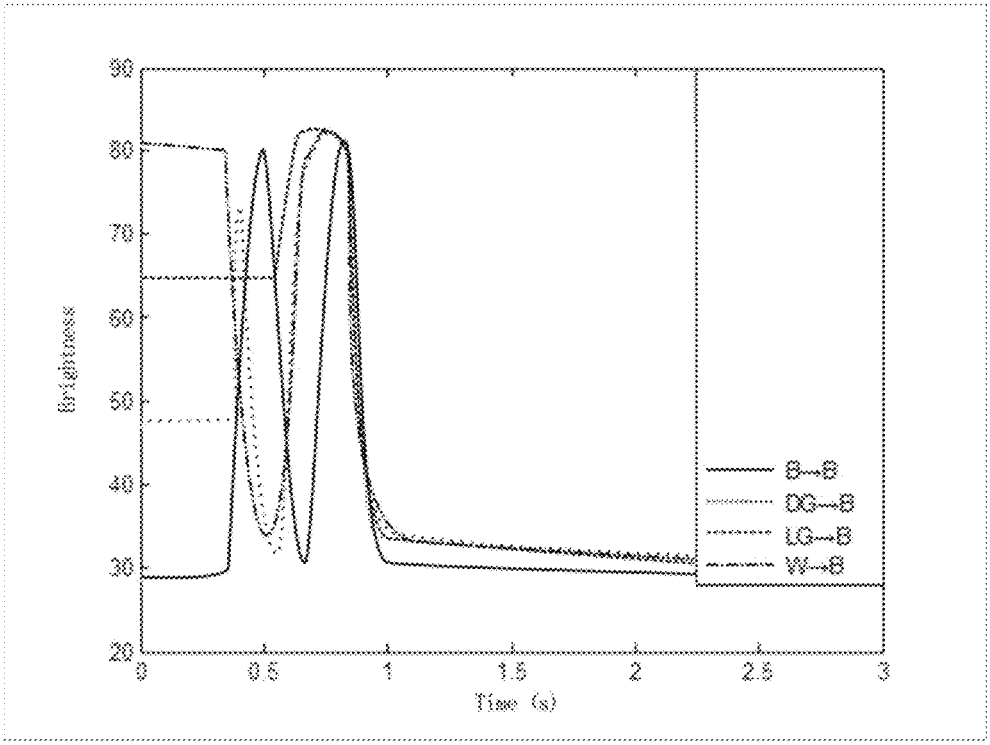
FIG. 12 is a driving effect diagram D' when applying the driving waveform in the first embodiment of the driving method for reducing ghosting of an EPD according to the disclosure.
Figure 15:
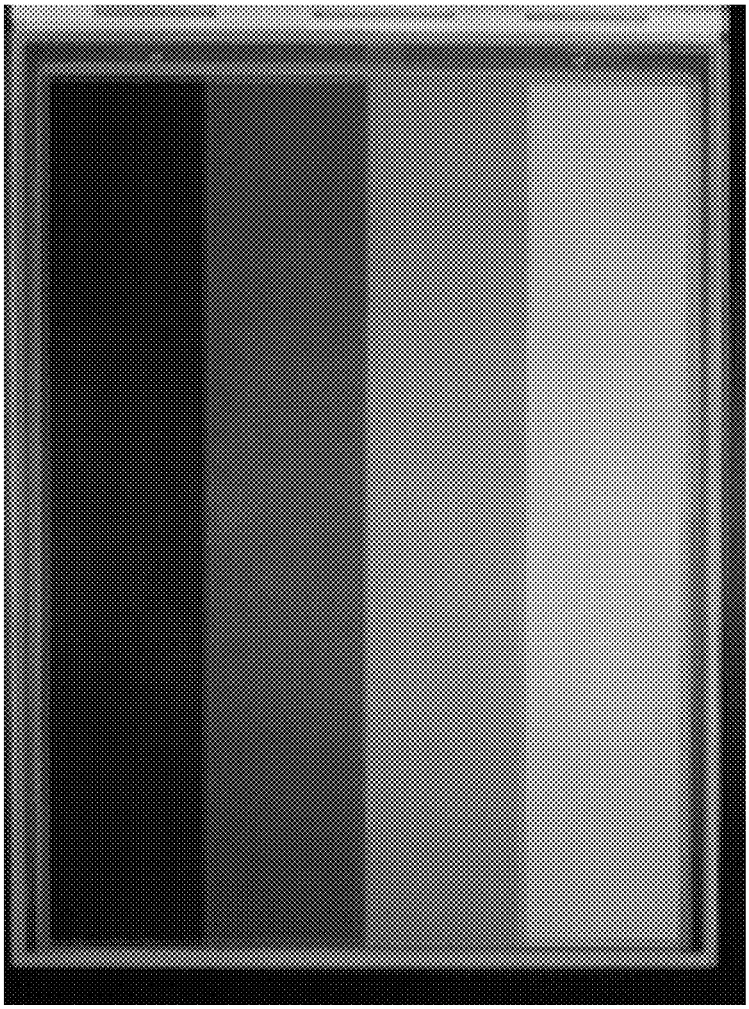
FIG. 15 is a schematic diagram of a ghosting-reduced image after applying the driving waveform in the first embodiment of the driving method for reducing EPD ghosting according to the disclosure.

FIGS. 9-12 show the change in brightness of the measured pixels before and after applying the driving waveform in the first embodiment of the disclosure. W, LG, BG and B denote the brightness of pixels in four original gray levels, i.e., white, light gray, dark gray and black, respectively. FIG. 9 shows a curve of the brightness after the pixels in the four original gray levels W, LG, BG and B are refreshed to the target gray level white by using the driving waveform in the first embodiment of the disclosure; FIG. 10 shows a curve of the brightness after the pixels in the four original gray levels W, LG, BG and B are refreshed to the target gray level light gray by using the driving waveform in the first embodiment of the disclosure; FIG. 11 shows a curve of the brightness after the pixels in the four original gray levels W, LG, BG and B are refreshed to the target gray level dark gray by using the driving waveform in the first embodiment of the disclosure; and, FIG. 12 shows a curve of the brightness after the pixels in the four original gray levels W, LG, BG and B are refreshed to the target gray level black by using the driving waveform in the first embodiment of the disclosure. It can be known from the curve in FIG. 9 that the four curves refreshed to the target gray level white are approximately converged at the brightness of the same target gray value. The results shown in FIGS. 10-12 are the same as that in FIG. 9, and shall be omitted here. Therefore, it can be known that the reflectivity approximately reaches the same target gray level after the pixels in different original gray levels are refreshed to the same target gray level by using the driving waveform in the first embodiment of the disclosure. Referring to FIG. 15, the ghosting residues are weakened, and the display effect is improved greatly when the driving waveform in the first embodiment of the disclosure is applied to the EPD.

Figure 14:
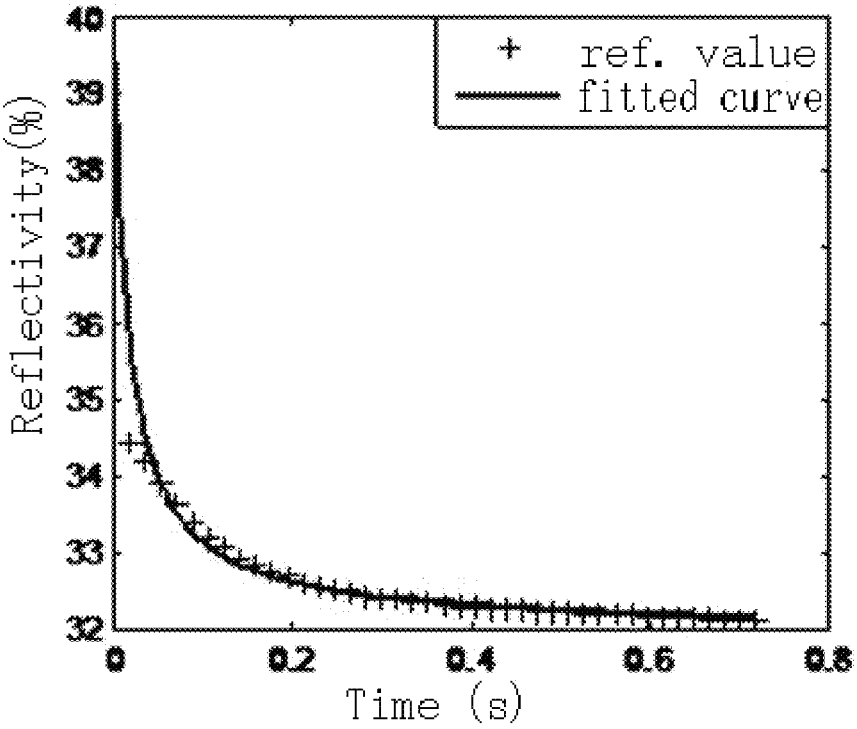
FIG. 14 is a diagram showing the relationship between a change in reflectivity of EPD pixels and the time at the end of driving.

FIG. 14 shows the change in reflectivity of an EPD in the reference gray level after the driving voltage is cancelled, and the change can be well fitted hyperbolically. The change in reflectivity of the reference gray level is an effective way to provide the correction of the reference gray level. In addition, the magnitude of the correction can be calculated by curve fitting, so that the accurate reference gray level is obtained. During the formation of the reference gray level of the driving waveform, the value of reflectivity in the original gray level is biggest as the reference gray level of the driving waveform Therefore, when the reference gray level is formed, a certain standing time is required to form a consistent value of the reference gray level. In addition, the waiting time can be calculated by curve fitting.

Figure 13:
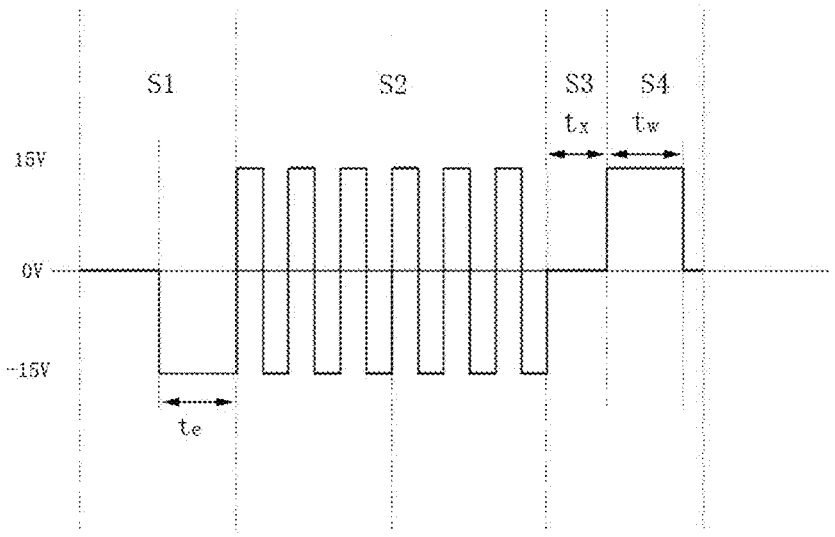
FIG. 13 is a schematic diagram of a driving waveform in a second embodiment for reducing ghosting of an EPD according to the disclosure.

FIG. 13 shows a driving waveform of a second embodiment of the driving method for reducing ghosting in an EPD according to the disclosure, where, in the step S2, there are six forward pulse square waves and six backward pulse square waves, where the forward pulse square waves and the backward pulse square waves both have a pulse width of 0.02 seconds and the voltage amplitude is 15 V, but have opposite directions. The specific implementation is the same as the first embodiment and will be omitted here.

The foregoing description merely shows the preferred disclosure embodiments, and the disclosure is not limited to the above implementations. All technical effects of the disclosure obtained by any identical means shall fall into the protection scope of the disclosure. Various different modifications and alternations can be formed as the technical solutions and/or implementations within the protection scope of the disclosure.

The invention claimed is:

1. A driving method for reducing ghosting of an EPD with a driving voltage waveform applied to a driving electrode in the EPD to realize display driver, the method comprising the following steps:

S1: erasing an original image;

S2: activating electrophoretic particles;

S3: standing the electrophoretic particles; and

S4: writing a new image;

wherein, in the step S3, the electrophoretic particles are stood for a preset duration (tx), wherein the calculation of the value of the preset duration (tx) comprises the following steps:

S01: at the end of the step S2, measuring a change in reflectivity of an EPD over time, and taking a limited number of reflectivity values of the EPD and coordinate points of the elapsed time;

S02: establishing a mathematical model equation $$y = \frac{P1}{x} + P0$$

where y is the reflectivity of the EPD, x is the elapsed time at the end of the step S2, and P1 and PO are hyperbolic function coefficients;

S03: substituting the coordinate points into the mathematical model equation to calculate values of the hyperbolic function coefficients P1 and P0, and substituting the values of P1 and P0 into the mathematical model equation to obtain the mathematical model equation; and S04: specifying a value range of at least one of y and x according to the requirements for the reflectivity and the duration of the driving voltage waveform, and calculating the value of the desired preset duration (tx) for satisfying the requirements.

2. The driving method for reducing ghosting of the EPD according to claim 1, wherein, in the step S3, a driving voltage of 0 V is applied within the preset duration (tx).

3. The driving method for reducing ghosting of the EPD according to claim 1, wherein, in the steps from S1 to S4, the driving voltage waveform within one period complies with a DC balance.

4. The driving method for reducing ghosting of an EPD according to claim 1, wherein the duration (te) of a non-zero driving voltage in the step S1 is equal to the duration (tw) of a non-zero driving voltage in the step S4.

5. The driving method for reducing ghosting of the EPD according to claim 1, wherein, in the steps from S1 to S4, the driving voltage waveform is square.

6. The driving method for reducing ghosting of the EPD according to claim 1, wherein the reference gray level is the white gray level.

* * * * *